US006470550B1

(12) United States Patent
Kowalczyk et al.

(10) Patent No.: US 6,470,550 B1
(45) Date of Patent: Oct. 29, 2002

(54) METHODS OF MAKING TOOLING TO BE USED IN HIGH TEMPERATURE CASTING AND MOLDING

(75) Inventors: James E. Kowalczyk, Saginaw, MI (US); Rick J. Bolyea, Fraser, MI (US)

(73) Assignees: Shear Tool, Inc., Saginaw, MI (US); Flame Spray Coating Co., Inc., Fraser, MI (US)

( * ) Notice: Subject to any disclaimer, the term of this patent is extended or adjusted under 35 U.S.C. 154(b) by 0 days.

(21) Appl. No.: 09/708,929

(22) Filed: Nov. 8, 2000

Related U.S. Application Data

(60) Provisional application No. 60/164,708, filed on Nov. 11, 1999.

(51) Int. Cl.[7] ..... B22D 19/10

(52) U.S. Cl. ..... 29/402.18; 164/92.1; 164/138; 228/122.1; 228/194

(58) Field of Search ..... 29/402.18, 423, 29/458; 164/92.1, 138, 312; 228/122.1, 194, 215

(56) References Cited

U.S. PATENT DOCUMENTS

| | | | | | |
|---|---|---|---|---|---|
| 3,588,028 | A | * | 6/1971 | Okamoto et al. | 249/116 |
| 4,037,646 | A | * | 7/1977 | Hara et al. | 164/418 |
| 4,086,953 | A | * | 5/1978 | Kraklau | 164/312 |
| 4,089,679 | A | * | 5/1978 | Zecman | 420/105 |
| 4,197,902 | A | * | 4/1980 | Von Jan et al. | 164/418 |
| 4,589,468 | A | * | 5/1986 | Misera et al. | 164/418 |
| 4,614,630 | A | * | 9/1986 | Pluim, Jr. | 264/219 |
| 4,624,403 | A | * | 11/1986 | Kohno et al. | 228/122 |
| 4,702,299 | A | * | 10/1987 | Gravemann | 164/137 |
| 4,704,079 | A | * | 11/1987 | Pluim, Jr. | 425/190 |
| 4,733,715 | A | * | 3/1988 | Matsuzaki et al. | 164/306 |
| 4,784,313 | A | * | 11/1988 | Godziemba-Maliszewski | 228/194 |
| 4,911,225 | A | * | 3/1990 | Leppanen | 164/459 |
| 4,926,926 | A | * | 5/1990 | Zecman | 164/312 |
| 5,005,756 | A | * | 4/1991 | Muggeo et al. | 228/127 |
| 5,010,946 | A | * | 4/1991 | Nogami et al. | 164/312 |
| 5,012,856 | A | * | 5/1991 | Zecman | 164/312 |
| 5,230,380 | A | * | 7/1993 | Sato | 164/418 |
| 5,322,111 | A | * | 6/1994 | Hansma | 164/312 |
| 5,323,838 | A | * | 6/1994 | Hamashima et al. | 164/113 |
| 5,611,477 | A | * | 3/1997 | Wang | 228/107 |
| 5,711,366 | A | * | 1/1998 | Mihelich et al. | 164/312 |
| 5,819,839 | A | * | 10/1998 | Mihelich et al. | 164/312 |
| 6,283,195 | B1 | * | 9/2001 | Chandley et al. | 164/113 |

FOREIGN PATENT DOCUMENTS

| | | | | |
|---|---|---|---|---|
| EP | 255475 | * | 2/1988 | 164/312 |

* cited by examiner

*Primary Examiner*—David P. Bryant
*Assistant Examiner*—Essama Omgba
(74) *Attorney, Agent, or Firm*—Reising, Ethington, Barnes, Kisselle, Learman & McCulloch, P.C.

(57) ABSTRACT

A method of making or reconstituting tooling to be used in the processing of high temperature molten material comprises machining an undercut in the tooling surface which terminates at a shoulder and provides an inset barrier receiving surface; a chemical barrier providing interface coating system to which a ceramic-based material will fuse, is fused over the undercut receiving surface. Then a thermally-insulative ceramic-based coating is fused to the interface system to fill the undercut and merge with the tooling surface.

23 Claims, 4 Drawing Sheets

METHODS OF MAKING TOOLING TO BE USED IN HIGH TEMPERATURE CASTING AND MOLDING

The present application claims the priority of U.S. provisional application No. 60/164,708, filed Nov. 11, 1999. This invention relates to tooling systems which are subjected to the high temperatures of molten materials in industries such as the aluminum, titanium-squeeze, and other pressure casting, vacuum casting, gravity casting or molding industries to increase the useful life of the tooling implements.

BACKGROUND OF THE INVENTION

The tooling used in such industries is appropriately referenced as perishable tooling and includes, but is not limited to, such tooling components as shot sleeves, ladles, inner and outer tips, runners, dies, and mold cavities. Some of such tooling is virtually constantly in contact with molten metals having temperatures ranging up to 1400° F. and beyond, and the conventional steel tooling tends to rapidly corrode and erode. Extreme heat, coupled with the pressures used in the process, tend to cause rapid oxidation of the tooling and its rapid decomposition or deterioration. During the time when the corroded tooling is being removed and replaced, the machinery is down and unproductive.

Cooling of the tooling in the work environment is not a practical answer for the problem because it causes premature solidification of the metal being cast, resulting, for example in improper filling of the molds and unacceptable castings.

While many steels have been evaluated in attempts to promote life cycle improvement for such tooling, H-13 Hot Work Die Steels have proven to be the most cost-effective material to use. The typical life of a shot sleeve made from this material is about 40,000 cycles, or approximately a period of three to four weeks in a normal production facility. In molds used in the pressure casting industry, which also need frequent replacement, various ceramic and cermet molds have also been tried with little success. The ceramics and cermets are susceptible to fracture from impact stresses and the compressive stresses induced during the heat-up or cool-down phases of operating the equipment.

SUMMARY OF THE INVENTION

The present invention is concerned with both machining an underlying metal substrate to provide an undercut or isolated surface with relation to the dimensions desired and then filling the undercut, first with a thermally compatible interface system capable of marrying a wear resistant ceramic coating to the metal, and finally with the ceramic coating which contacts the molten metal at the high temperatures of the metal. The ceramic coating barrier has low thermal conductivity and is resistant to the corrosive action of the molten metal at the high temperatures involved. It not only provides a highly wear resistant surface for the molten metals and various moving parts to impinge upon, it provides an insulating characteristic which allows the tooling part to be cooled without transferring that cooling to the molten metal. This attribute reduces the oxidizing effect of the molten metal on the surface of the component without deleteriously affecting the temperature of the molten pool of cast metal. The ceramic barrier further well resists oxidation and provides a very low co-efficient of friction surface for the molten metals and tooling parts to thereby reduce adhesive and abrasive wear on the tooling parts.

Magnesium zirconate ceramic, and various other thermally insulative ceramic barriers to be identified herein have been employed, or are expected to be employed, as the tooling component contact surface. Cobalt chromium alloy material has been well employed as an interface or bonding layer, and other interface layers expected to be employed will also be identified herein. In some instances, it has been found desirable to utilize an intermediate layer or layers between the initial coating and the ceramic barrier surface which will also be identified.

After surface preparation, as by shot blasting and cleaning, the interface coating is applied to the tooling component using a standard plasma deposition or high velocity, high oxygen fuel deposition device and, after the interface barrier is applied and fused to the metal, the ceramic barrier is applied, using a standard plasma deposition system or any other suitable particulate deposition system. Thereafter, the surface of the ceramic is polished to provide a glass-smooth surface which is free of imperfections and has a coefficient of friction that is as low as possible.

It is a principal object of the invention to provide a new technology for molten material contacting tooling of the type mentioned, which compositely utilizes machining techniques in combination with a composite barrier material of high integrity which the machining entraps or isolates in a manner to protect the edges of the barrier material.

A further object of the invention is to provide tooling which has a greatly extended service life and provides tooling components which are harder, tougher, more wear resistant, and far more durable.

Still another object of the invention is to provide a method of manufacturing tooling of the character described which is far more economical to utilize considering both the cost of replacement of the tooling and the machinery downtime which accumulates with the present day, far more frequent replacement of tooling components.

Other objects and advantages of this invention will become apparent with reference to the accompanying drawings and the accompanying descriptive matter.

GENERAL DESCRIPTION OF THE DRAWINGS

The presently preferred embodiment of the invention is disclosed in the following description and in the accompanying drawings, wherein.

DETAILED DESCRIPTION OF THE DRAWINGS

Figure 1:
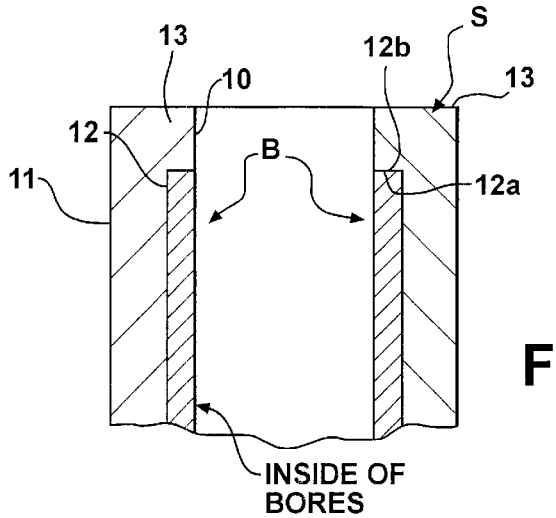
FIG. 1 is a fragmentary, sectional elevational view which shows the upper end of a molten material carrying sleeve and illustrates the entrapment of the coated material.

Referring now, more particularly, to the accompanying drawings, and in the first instance to FIG. 1, a sleeve, generally designated S, such as a shot sleeve, is schematically disclosed as having an internal annular wall 10, and an exterior wall 11. The is sleeve S may be referenced broadly as a tooling member. Throughout most of its length, the interior wall 10 is circumferentially undercut or recessed as at 12 to receive a composite barrier coating, generally designated B, which will presently be more specifically described. It is to be understood that the opposite end of the sleeve S may be identical, insofar as the machining required to produce the undercut 12 in the surface 10 is concerned, and similarly takes place at a slightly spaced axial distance from the end walls 13 of the sleeve S, as shown. In this example, the ends 12*a* of the composite coating B are entrapped and preserved by the undercut end walls 12*b* to which they fuse.

Figure 2:
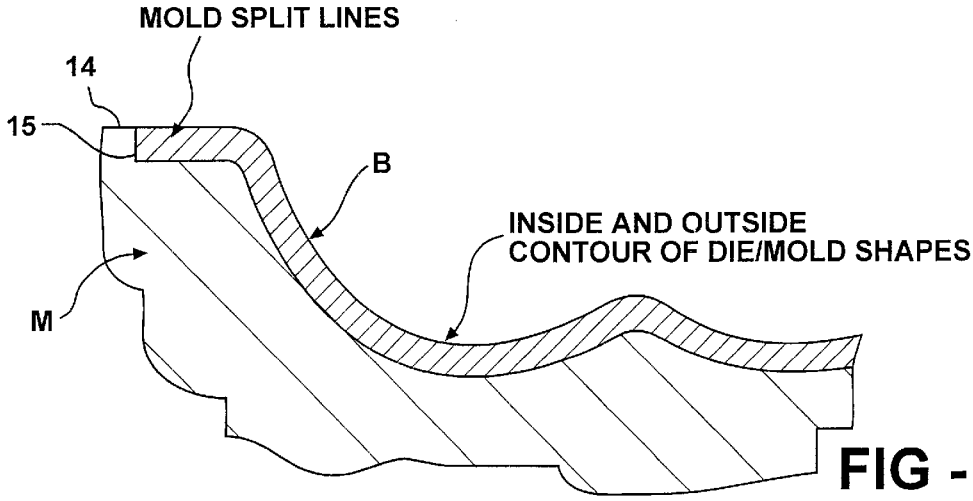
FIG. 2 is a fragmentary schematic sectional elevational view of a mold showing a portion of its interior contour and the manner in which the coating material is trapped.
Figure 3:
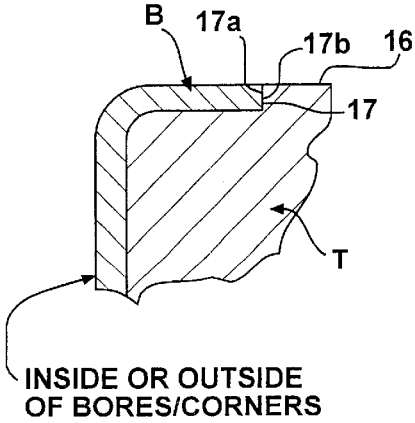
FIG. 3 is a fragmentary, schematic, sectional elevational view illustrating an alternative manner of entrapping the coating material.
Figure 4:
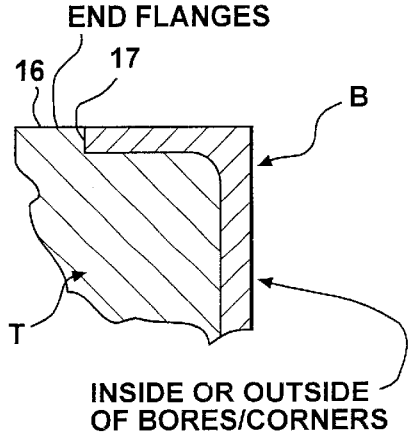
FIG. 4 is a similar fragmentary, sectional, elevational view.
Figure 5:
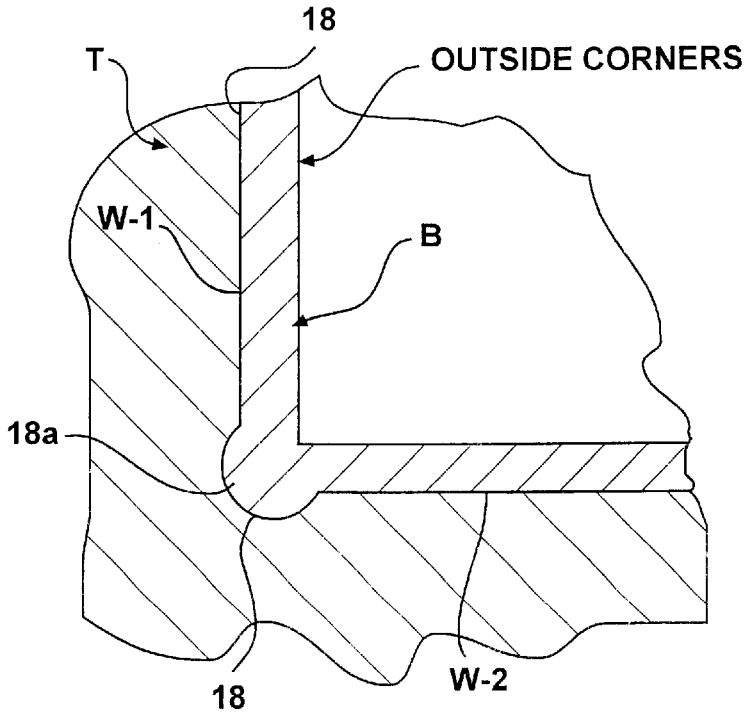
FIG. 5 is a fragmentary sectional elevational view illustrating a manner of forming an outside corner on an entrapped coating.

A similar result is reached in FIG. 2, which depicts a mold, generally designated M, having a mold contour surface 14, which is undercut at its perimeter as at 15 to receive the coating material B. Here the end walls 15*a* of the coating B are entrapped and preserved by the end walls 15*b* of the undercut to which they fuse. Again, the mold M may be broadly referenced as a tooling member.

Where the surface which must be protected extends the full length of the bore, as in FIGS. 3 and 4, the coating material, generally designated B, extends the full length of the bore or surface and around the end walls 16 of the tooling member which are undercut as at 17 to protect the edges of the barrier material B. The coating B not only fuses to the tooling throughout its length, the coating end walls 17*a* fuse to the undercut end walls 17*b*. FIG. 5 illustrates the outside corner of a tooling member T wherein the wall surfaces W-1 and W-2, which are undercut at their outer ends in the manner previously described, have an expanded bulged undercut 18 at their juncture. The barrier coating B which fuses to the wall surfaces W-1 and W-2 is expanded as at 18*a* to fill the undercut 18 and fuses to the wall surface 18.

Figure 6:
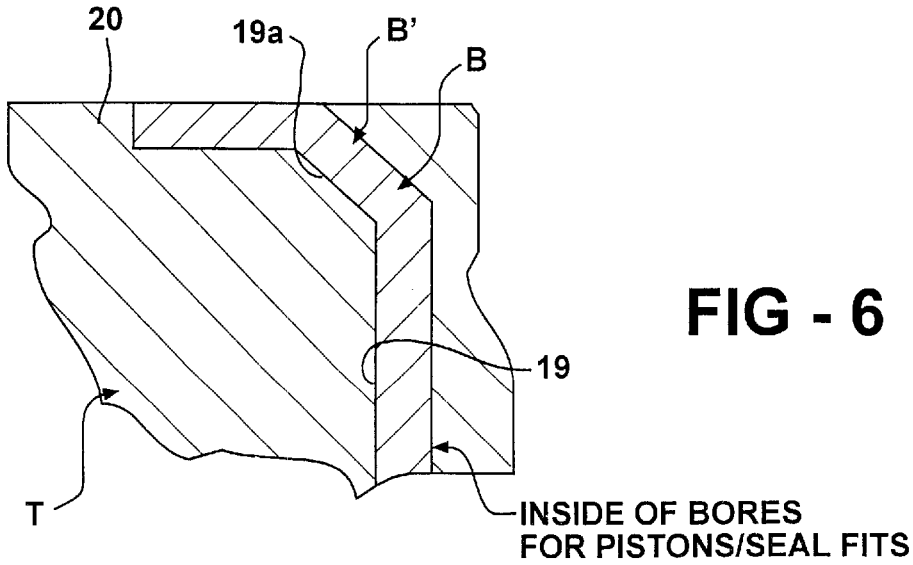
FIG. 6 is a schematic, fragmentary, sectional, elevational view illustrating the manner in which the ends of the barrier material may be isolated and entrapped when the material is applied to the interior of a cylinder bore in which a piston or plunger travels.
Figure 7:
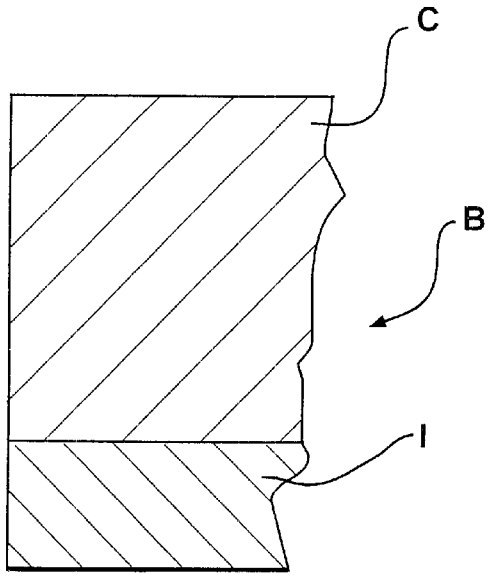
FIG. 7 is a greatly enlarged, fragmentary sectional elevational view of the composite coating only.

In FIG. 6, a tooling member T, is shown as having a bore surface, generally designated 19, which at its end 20 is undercut to flare outwardly as at 19*a*. In this tooling component, where the bore 19 receives a piston or plunger, the outer ends of the material B are isolated, because the piston does not engage the flared portion B' of the edge entrapped coating material which covers the flared end portion 19*a* and fuses to it.

Referring now more particularly to the barrier material B, it is to be understood that it includes an interface chemical barrier component I which will provide a high strength bond between the substrate surface of the metal tooling, which may be an H-13 hot work die steel, and an outer barrier coating C. The substrate, typically a steel, will have a minimum hardness of 28 Rockwell C. Component I may be referenced as an interface system. The coating C may be referenced as a ceramic-based material which can be defined as a vitrified product comprising of earthy substances made or used at higher temperatures, normally above 550 degrees F. The term ceramic-based is meant to include cermet material.

In producing tool components according to the invention, the first step is to further machine the already machined parts to provide the undercut and isolated surfaces and then to prepare the substrate surfaces to which the barrier coatings B will be applied, including the undercut end wall surfaces. This preparation may take the form of mechanically blasting the undercut surface area with shot material such as aluminum oxide or other appropriate well known particles, and then chemically or otherwise cleaning the surface to remove any aluminum oxide or other foreign material.

The interface barrier material is then applied to the surfaces of the undercut using a commercially available plasma deposition or high velocity oxygen fuel apparatus under the control of a computerized robotic device of commercially available character to provide a smooth fused coating I of uniform thickness and density. Then the vitrified or vitreous outer barrier component C is fused to the interface component I. The temperature coefficients of expansion of the substrate, interface, and layer C will be sufficiently similar that deleterious effects such as cracking and layer separation do not occur. The interface system I absorbs thermal coefficient differences between the substrate and ceramic material. The thickness for the interface layer I (where one interface layer is applied) is approximately in the range of 0.003–0.005 of an inch, and for the outer barrier material C is 0.010 to 0.015 of an inch, or a ratio of C to I in the range of about 3 to 5 to one.

An outer coating material C consisting of a magnesium zirconate ceramic with 76% zirconium oxide and 24% magnesium oxide by weight fused to an interface material consisting of a cobalt chromium alloy comprising 64% cobalt, 29% chromium, 6% aluminum, and 1% Yttrium by weight has provided excellent results. Several shot sleeves made according to the invention have been tested and have lasted up to ten times as long as the currently used steel sleeves. The cobalt chromium interface alloy I may be plasma sprayed and fused with a coating density of 6.9 G/cc to have a tensile bond strength of 8,000 psi and a macrohardness of about Rb 80. It will have a porosity in volume percent of less than 1.

The outer coating C may be plasma sprayed and fused with a coating density of 4.2 G/cc, a tensile bond strength of 3,000 psi, a typical macrohardness of Rc 31 and a typical microhardness of 400 DPH. It will have a porosity volume of no more than 6–10% and a service temperature limit up to 3000° F. The oxidation resistant coating texture C, as sprayed and fused, will be in the neighborhood of 250–400 micro aa and it will be machined to 8–16 micro aa. The layer C will have a low thermal conductivity in the neighborhood of 1.3 W/MK.

In tooling applications where the surfaces are more susceptible to wear and are not directly in contact with the molten cast metal puddle, a more wear resistant ceramic such as superfine aluminum oxide may be used as the ceramic barrier material C. This material is harder (approximately 66–70 Rc) but will have a lower heat insulative characteristic. This ceramic coating will also be plasma fused to also ensure a smooth coating consistent within a few thousandths of inch in uniformity and surface texture. The coating will have a uniform adequate thickness and density in the 99+ percent range to provide the best surface for final machining. Diamond honing and diamond grinding operations are useful for machining a glass smooth surface on the ceramic-based material C.

In addition to the material mentioned, the interface bonding layer I may be selected from the group comprising: Ni-17Cr-6Al-0.5Y; Ni-22Cr-10Al-1.0Y; Ni-23Cr-6Al-0.4Y; Ni-31Cr-11Al-0.6Y; Ni-23Co-20Cr-8.5Al-4Ta0.6Y;

Ni-20Cr-9Al-0.2Y; NiCr alloy-6Al; Ni-4.5Al; Ni-17.5Cr-5.5Al-2.5Co-0.5Y; Ni-26.5Cr-7Al-3.5Co.1-0Y; Ni-20Cr; Co-32Ni-21Cr-8Al-0.5Y; Co-25Cr-10Ni-7Al-5Ta-0.6Y; Co-29Cr-6Al-1Y; and Co-10Ni-25Cr-3Al-5Ta-0.6Y (all by weight percent). The outer insulative ceramic-based layer may be selected from the group comprising: $Al_2O_3$; $Al_2O_3$-3$TiO_2$; $Al_2O_3$-13$TiO_2$; $Al_2O_3$40Ti—$_2$; $Al_2O_3$50$TiO_2$; $ZrO_2$-5CaO-0.5$Al_2O_3$-0.4$SiO_2$; $ZrO_2$-24MgO; $ZrO_2$25CeO-2.5$Y_2O_3$; $ZrO_2$18$TiO_2$10$Y_2O$; $ZrO_2$-8$Y_2O_3$; $ZrO_2$-8$Y_2O_3$; and $ZrO_2$20$Y_2O_3$ (all by weight percent).

Figure 8:
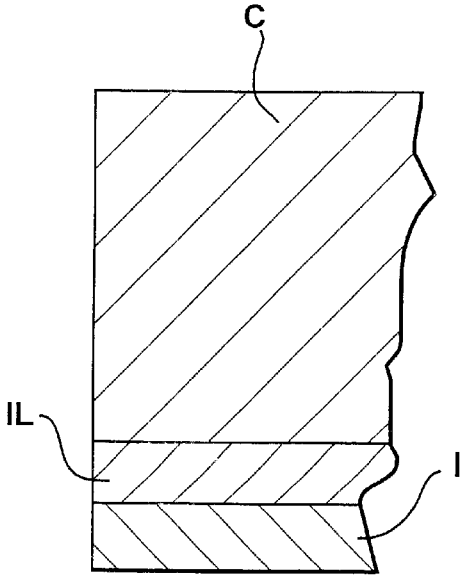
FIG. 8 is a view similar to FIG. 7 illustrating another embodiment of the invention.

In some instances, particularly where the entire part is immersed, as ladles are, for example, an intermediary layer IL may be introduced between the layers I and C, i.e., plasma sprayed over the bond layer and fused to it before the ceramic-based layer C is applied (see FIG. 8). Such intermediary layers may be selected from the group comprising: $Al_2O_3$-30NiAl; $MgZrO_3$-35NiCr; $MgZrO_3$-26Ni-7Cr-2Al; $Al_2O_3$-70NiAl; Zr-35NiAl; and Zr-65NiAl (all by weight percent). When the ladles are produced, the surface of the ceramic-based material may be finely polished using diamond impregnated rouge, such as a good jeweler's rouge. In this instance, the intermediate layer may have the same thickness as the layer I or the layers together may be equal to the thickness of the layer I, or another appropriate thickness. The composite layers I and IL may be referenced as an interface system.

Generally speaking, the method invented involves configuring the tooling via machining to provide protected isolated edge surfaces for each of the components of the barrier material B so that they will not be chipped or peel off due to mechanical impact or other adverse conditions which are possible, such as poor assembly procedure or minor component misalignment. The method broadly consists of preparing the surface area where the coatings will be applied for plasma or particle fusing, then applying an interface bonding barrier I to the component, which is relatively thin, but may be adjusted in thickness for the material being deposited, as well as the ceramic-based material being deposited upon it, and then plasma fusing a ceramic-based coating material C having low heat conductivity to the interface I, of a thickness which will provide sufficient wear resistance. The method may also be employed in remanufacturing tooling implements, such as spent shot sleeves, which are machined to receive, and then provided, with the barrier coating B. The interface barrier must be capable of absorbing thermal expansion co-efficient differences between the base steel or other substrate material and the ceramic-based coating without imparting catastrophic stresses to the ceramic-based coating, which is harder and more brittle. The ceramic-based layer C typically will be effective when exposed to temperatures up to 3000° F. and will insulate the layer I from temperatures above 1800° F.

Figure 9:
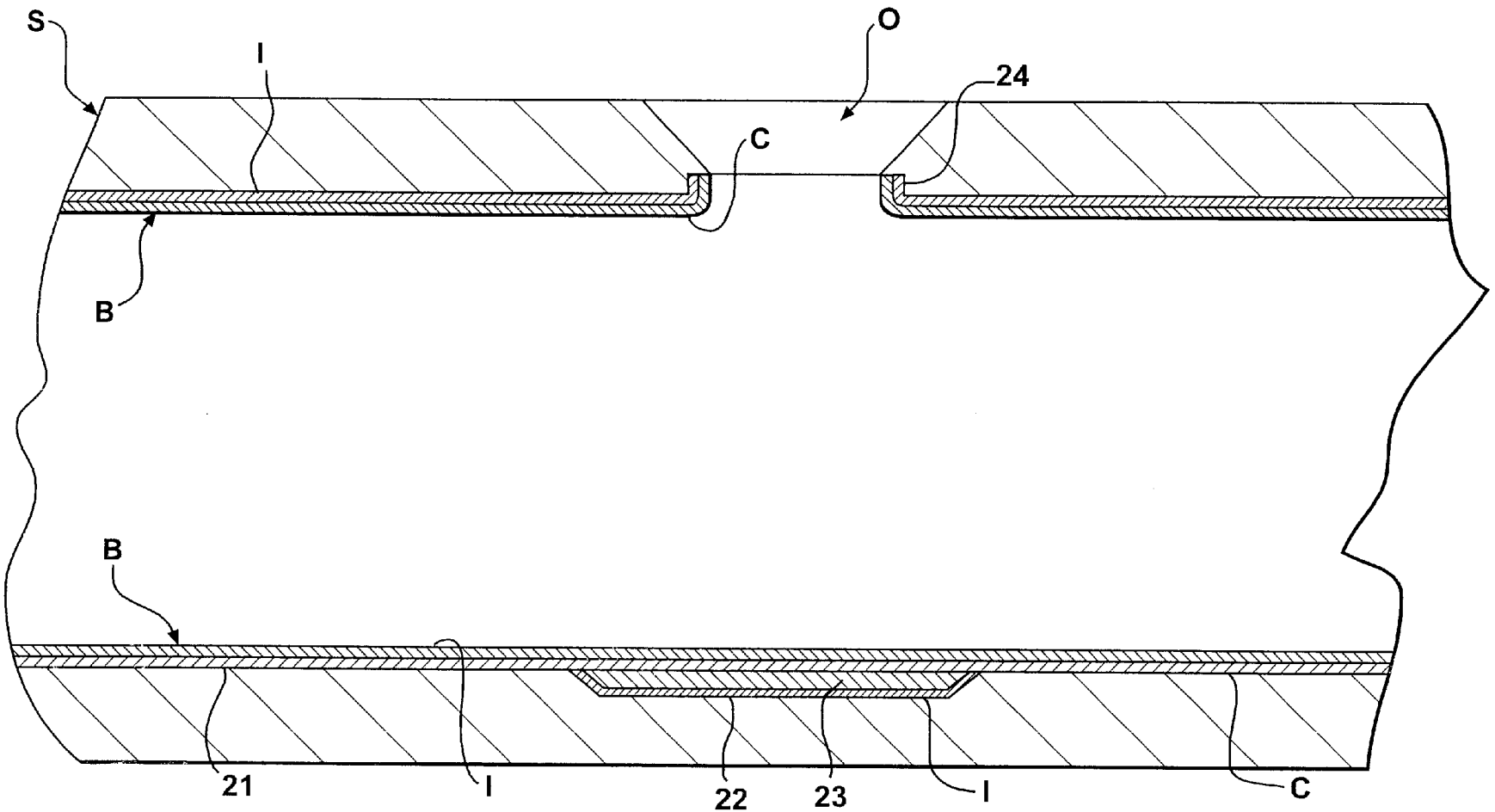
FIG. 9 is an enlarged schematic cross-sectional elevational view illustrating the configuration employed when a molten material transporting sleeve has a side entry port.

In FIG. 9, a sleeve tooling member S having a side opening O for the molten material instead of an axial opening is disclosed. In a typical seven-inch diameter sleeve, this means impact forces of considerable magnitude are created on the wall opposite opening O where forces reflecting a flow of molten aluminum weighing 130 pounds, for example, are imposed. In FIG. 9, the undercut 21 in which the barrier material B is received is further undercut to form a recess 22. This recess 22 then becomes the portion of the undercut opposite opening O and is treated also by preparing its surface in the same manner for an interface I such as the nickel chromium aluminum alloys and other interface compositions mentioned, including the cobalt chromium alloy. Once surface preparation via blasting and cleaning has occurred, an interface layer I as previously described is plasma spray fused to the substrate surface 22 and then a hardened layer of a metal carbide 23 such as tungsten carbide or chromium carbide is plasma spray fused to the interface layer I in the well surface 22 to fill recess 22. The interface layer I may be of the same thickness and hardness as previously and the layer 23 may be in the nature of 3 to 5 times the thickness of the interface layer. With surface preparation then of the entire undercut which now includes the exposed metal carbide surface 23, the barrier layer B is fused in exactly the manner previously disclosed by first fusing the interface system I to the entire surface and then fusing the barrier coating C. It is to be noted that the edges of the opening O at 24 are also undercut to entrap the barrier B. While not shown, the ends of the sleeve S will be formed in the manner illustrated in FIG. 1, for example, to provide the ends of the undercut 21.

The hard metal matrix composite 23 produces a more thermo-mechanical stress resistant sub-layer for the less hard steel improving the integrity of the ceramic coating and increasing its life cycle. Typically, the further undercut 22 will be in the range of 0.015 to 0.018 inches in depth and the metallic composite 23 which will have a hardness in the nature of 60–65 Rockwell C will have a thickness in the range of 0.012 to 0.015 inches when interface layer I has a thickness in the range of 0.002 to 0.003 inches. As previously, if the ceramic-based material is $AlO_2$ it will have a hardness in the range 66–72 Rc, and, if magnesium zirconate, in the range 62–68 Rc.

The disclosed embodiment is representative of a presently preferred form of the invention, but is intended to be illustrative rather than definitive thereof. For example, it is thought the invention may be useful when the substrate is a polymer die, extruder surface, lead acid battery mold, or molten glass production tooling. The invention is defined in the claims.

We claim:

1. In a method of making or reconstituting a tooling having a tool surface, to be used in the processing of high temperature molten material; the steps comprising:

a. machining an undercut surface in the tooling surface which terminates at a shoulder and provides an inset, edge-trapping receiving surface in the tooling with an end marginal wall;

b. preparing said receiving surface for the reception of a barrier layer which fills the undercut and merges with said tooling surface bordering said undercut;

c. fusing a chemical barrier providing an interface coating system to which a ceramic-based material will fuse, over said receiving surface as a layer portion of said barrier layer; and d. fusing a thermally-insulative ceramic-based coating material over said interface system as a second layer portion of said barrier layer.

2. The method of claim 1 wherein said interface coating system has an end wall portion which fuses to said end marginal wall and said ceramic-based material fuses to said end wall portion of said interface system.

3. The method of claim 2 wherein said interface system consists of a single interface coating.

4. The method of claim 2 wherein said interface system consists of more than a single interface coating.

5. The method of claim 2 wherein said ceramic-based material is essentially a magnesium zirconate fused to essentially a cobalt chromium alloy interface system.

6. The method of claim 5 wherein said interface system has a thickness in the range of 0.003–0.010 of an inch and said ceramic-based material has a thickness in the range of 0.010 to 0.015 of an inch.

7. The method of claim 2 wherein said tooling surface is a steel surface.

8. The method of claim 2 wherein said interface coating system has a porosity less than one percent by volume.

9. The method of claim 2 wherein said ceramic-based coating has a porosity less than about ten percent by volume.

10. The method of claim 1 wherein said tooling comprises a sleeve including a side wall having an opening through which molten material is introduced to the interior of said sleeve and an opposite side wall surface upon which said molten material impinges, said sleeve including said opposite side wall surface having said undercut, and steps performed prior to step (b) comprise:

a. machining a further reduced area inset undercut surface in said receiving surface opposite said opening; and b. fusing a hard impact resistant coating of substantially greater hardness than said barrier layer in said further inset undercut.

11. The method of claim 10 wherein a further interface layer is fused over said further undercut surface and said hard impact resistant coating comprises a metallic carbide fused thereto to fill only said further undercut.

12. The method of claim 11 wherein said further undercut surface, said further interface layer and said metallic carbide coating have an end wall, said further undercut surface end wall is fused to said further interface end wall, and said further interface end wall is fused to said impact resistant metal carbide coating end wall.

13. The method of claim 1 wherein said undercut is on the order of 0.013–0.025 inches in thickness, said interface system is in the range of 0.003–0.005 of an inch in thickness, and said ceramic-based material is in the range of 0.010 to 0.015 of an inch.

14. The method of claim 1 wherein said tooling is a mold surface.

15. The method of claim 1 wherein said tooling is a member having a bore and said undercut extends the full axial length of said bore and then terminates in a lateral portion.

16. The method of claim 15 wherein said lateral portion includes an axially outwardly inclined portion.

17. The method of claim 1 wherein said tooling is a product having exterior walls meeting at an outside corner and said undercut extends along said walls, the undercut being bulged at said corner.

18. The method of claim 1 wherein said tooling is a member having walls meeting at a corner and said undercut extends in said walls.

19. The method of claim 1 wherein said tooling is a sleeve with an interior surface having ends and said undercut extends in said interior surface to locations just short of the ends of said interior surface.

20. The method of claim 1 wherein said ceramic-based coating is selected from a group comprising: $Al_2O_3$; $Al_2O_3$-3TiO2; $Al_2O_3$-13$TiO_2$; $Al_2O_3$-40Ti-$_2$; $Al_2O_3$-50$TiO_2$; $ZrO_2$-5CaO-0.5$Al_2O_3$-0.4$SiO_2$; 76$ZrO_2$-24MgO; $ZrO_2$25CeO-2.5$Y_2O_3$; $ZrO_2$-18$TiO_2$-10$Y_2O$; $ZrO_2$-8$Y_2O_3$; $ZrO_2$-8$Y_2O_3$; and $ZrO_2$-20$Y_2O_3$.

21. The method of claim 1 wherein the interface system is selected from a group comprising: 64Co-29Cr-6Al-1Y; Ni-17Cr-6Al-0.5Y; Ni-22Cr-10Al-1.0Y; Ni-23Cr-6Al-0.4Y; Ni-31Cr-11Al-0.6Y; Ni-23Co-20Cr-8.5Al-4Ta-0.6Y; Ni-20Cr-9Al-0.2Y; NiCr alloy-6Al; Ni-4.5Al; Ni-17.5Cr-5.5Al-2.5Co-0.5Y; Ni-26.5Cr-7Al-3.5Co-1.0Y; Ni-20Cr; Co-32Ni-21Cr-8Al-0.5Y; Co-25Cr-10Ni-7Al-5Ta-0.6Y; Co-29Cr-6Al-1Y; and Co-10Ni-25Cr-3Al-5Ta-0.6Y.

22. The method of claim 21 wherein said interface system includes an intermediate layer over a bond layer comprising one of the compositions defined in the group of claim 19, said intermediate layer being selected from the a group comprising: $Al_2O_3$-30NiAl; $MgZrO_3$-35NiCr; $MgZrO_3$-26Ni-7Cr-2Al; $Al_2O_3$-70NiAl; Zr-35NiAl; and Zr-65NiAl.

23. The method of claim 1 wherein said thickness of said ceramic-based material is on the order of 3–5 times the thickness of said interface system.

* * * * *

UNITED STATES PATENT AND TRADEMARK OFFICE

CERTIFICATE OF CORRECTION

PATENT NO. : 6,470,550 B1 
DATED : October 29, 2002
INVENTOR(S) : James E. Kowalczyk and Rick J. Bolyea It is certified that error appears in the above-identified patent and that said Letters Patent is hereby corrected as shown below:

Column 8,
Line 17, change "3TiO2; $Al_2O_3TiO_2$; $Al_2O_3$-40Ti-$_2$"; to
-- $3TiO_2$; $Al_2O_3$-$13TiO_2$; $Al_2O_3$-$4OTiO_2$ --.
Line 31, change "19" to -- 21 --;
Line 32, cancel -- the --.

Signed and Sealed this

Twenty-fifth Day of February, 2003

JAMES E. ROGAN
*Director of the United States Patent and Trademark Office*